US005179882A

United States Patent [19]

Takeuchi et al.

[11] Patent Number: 5,179,882

[45] Date of Patent: Jan. 19, 1993

[54] WASTE REMOVING APPARATUS

[75] Inventors: Takayuki Takeuchi, Takarazuka; Isao Hirata, Settsu, both of Japan

[73] Assignees: Nippon Die Steel Co., Ltd.; Asahi Machinery Ltd., Osaka, Japan

[21] Appl. No.: 481,562

[22] Filed: Feb. 20, 1990

[30] Foreign Application Priority Data

Feb. 20, 1989 [JP] Japan ..... 1-042315

[51] Int. Cl.[5] ..... B26D 7/18

[52] U.S. Cl. ..... 83/125; 83/128; 83/138; 493/342

[58] Field of Search ..... 493/82, 83, 342, 373, 493/472; 83/125, 128, 138, 139

[56] References Cited

U.S. PATENT DOCUMENTS

| | | | |
|---|---|---|---|
| 1,811,987 | 6/1931 | Wales | 83/128 |
| 2,434,375 | 1/1948 | Van Saun | 493/342 |
| 2,577,424 | 12/1951 | Luehrs | 493/342 |
| 2,655,842 | 10/1953 | Baumgartner | 493/342 |
| 3,048,069 | 8/1962 | Berlin et al. | 83/138 |
| 3,211,034 | 10/1965 | Andris | 83/128 |
| 3,606,824 | 9/1971 | Remington | 493/342 |
| 3,653,304 | 4/1972 | Lenoir | 493/342 |
| 3,784,070 | 1/1974 | Vossen | 493/342 |
| 4,015,495 | 4/1977 | Yerly | 493/342 |
| 4,175,686 | 11/1979 | Lang | 493/373 |
| 4,371,369 | 2/1983 | Wright | 493/373 |
| 4,452,595 | 6/1984 | Huff | 493/83 |
| 4,530,693 | 7/1985 | Isowa | 493/373 |
| 4,856,393 | 8/1989 | Braddon | 83/138 |
| 4,951,537 | 8/1990 | Bennett | 83/128 |
| 4,963,126 | 10/1990 | Jesch | 493/342 |

FOREIGN PATENT DOCUMENTS

| | | |
|---|---|---|
| 419900 | 11/1923 | Fed. Rep. of Germany . |
| 655320 | 12/1937 | Fed. Rep. of Germany . |
| 2325631 | 1/1979 | Fed. Rep. of Germany . |

*Primary Examiner*—William E. Terrell
*Attorney, Agent, or Firm*—Wenderoth, Lind & Ponack

[57] ABSTRACT

A waste removing apparatus is used in a punching machine for manufacturing a carton and removes a waste region of a sheet inserted between a movable die and a fixed die by cutting the sheet along a punching line formed thereon. Two molded plates are provided on the movable die and the fixed die, respectively so as to sandwich a product region of the sheet therebetween. The molded plates have areas slightly smaller than the area of the product region to reliably separate the waste region of a sheet from the product region thereof, even though the sheet is thin and, as such, flexible.

6 Claims, 8 Drawing Sheets

WASTE REMOVING APPARATUS

BACKGROUND OF THE INVENTION

1. Field of the Invention

The present invention relates to a waste removing apparatus for use in a punching machine for manufacturing a carton and, more particularly, to an apparatus for separating the waste region of a sheet, on which a punching line is formed in a previous process, from the product region of the sheet inserted between a fixed die and a movable die by inserting blades mounted on both the fixed and removable dies into blade inserting portions so as to remove the waste therefrom.

2. Description of the related art

Heretofore, according to a known waste removing apparatus for use in a punching machine, a sheet 1 having a required line (L) formed on a sheet (S) as shown in FIG. 12 is transported to, for example, a waste removing apparatus as shown in FIG. 13 so as to remove a waste region 2 from the sheet 1. Thus, a product (P) is manufactured.

The waste removing apparatus for use in a die-cutting machine shown in FIG. 13 is disclosed in Japanese Patent Publication No. 61-49080. According to the disclosure, a fixed die 3 has nicks 4 formed in the periphery of sheet cutting portions and a plurality of curved leaf springs 6 are spaced at certain intervals from each other in a product region sandwiching region 5 thereof, and a movable die 7 has blades 8. The movable die 7 is moved toward the fixed die 3 so as to insert the blades 8 into the corresponding nicks 4. Thus, the waste region 2 is stripped from the sheet 1.

According to a known waste removing apparatus, in order to separate a waste region, whose configuration is complicated, from a product region, a projection whose configuration is similar to that of the waste region is mounted on a movable die and a pin is mounted on a fixed die. The pin is moved upward by a driving mechanism and brought into contact with the projection with the waste region sandwiched between the projection and the pin. Thus, the waste region, or the waste is removed from the apparatus.

In the waste removing apparatus shown in FIG. 13, the leaf springs 6 are mounted on the fixed die 3 at certain intervals therebetween in the product sandwiching area 5. Therefore, the product region (P) of the sheet 1 to be die-cut is supported by the leaf springs 6 alone, i.e., the product region (P) of the sheet 1 is partially supported. According to this construction, a thick, or a hard sheet such as a cardboard can be held to be flat, but a thin, or a soft sheet such as boxes of cake, cosmetics and the like is flexed between the leaf springs 6. Thus, in the case of a thin sheet, the waste region 2 cannot be separated reliably from the product region (P) by the waste removing apparatus.

In addition, even though the sheet 1 is thick enough to be supported partially by the leaf springs 6 without being flexed, the product region (P) is likely to wrinkle when the product region (P) and the waste region 2 are separated from each other. This is because when the product region (P) is sandwiched between the movable die 7 and the fixed die 3, pressure cannot be applied thereto uniformly, i.e., pressure applied to the product region (P) supported by the leaf springs and that applied to the product region (P) not supported thereby are different from each other. When ten to twenty product regions to be formed into small containers such as boxes of cake or cosmetics are punched from a sheet, needless to say, it is necessary to punch many portions. Therefore, unless the sheet 1 is uniformly supported by the leaf springs 6, the waste region 2 cannot be reliably stripped from the sheet 1.

In the apparatus having a projection similar to that of the waste region and a pin to be moved upward by a driving mechanism in correspondence with the movement of the projection, it is necessary to mount the pin on the fixed die at a correct position thereof, which necessitates troublesome work. Further, the pin is disposed in the space in which wastes fall after the waste region is separated from the product region. Thus, the pin obstructs the smooth falling of the waste.

SUMMARY OF THE INVENTION

The present invention has been made to overcome the disadvantages described above and has its essential object to provide a waste removing apparatus which can reliably separate the waste region of a sheet from the product region thereof, even though the sheet is thin and, as such, flexible.

It is another object of the present invention to provide a waste removing apparatus which can uniformly apply pressure to the product region of a sheet so that a lot of product regions can be punched from the sheet.

It is still another object of the present invention to provide a waste removing apparatus which can reliably separate the waste region of a sheet from the product region thereof, without the provisions of a pin and a projection, the configuration of which is similar to the waste region.

In order to accomplish the above and other objects, according to one preferred embodiment of the present invention, there is provided a waste removing apparatus for use in a punching machine for manufacturing a carton for removing a waste region of a punched sheet inserted between a movable die and a fixed die by cutting the sheet along a punching line formed thereon, two molded plates and provided on the movable die and the fixed die, respectively, so as to sandwich a product region of the sheet therebetween and having areas slightly smaller than the area of the product region thereof.

According to another preferred embodiment, blades for cutting a sheet along a punching line are projectingly mounted on a base plate of a movable die which serves as an upper die. A molded plate, comprising thin plates whose area is slightly smaller than that of the product region of the sheet is provided o the base plate of the movable die. The molded plate is connected to the base plate of the movable die through a plurality of elastic members mounted on the top surface of the molded plate, so that the bottom surface of the molded plate is disposed below bottom portions of blades on the base plate by the urging force of the elastic members. A lower molded plate mounted on the top surface of the fixed die, serving as a lower die, is disposed to confront the upper molded plate mounted on the movable die serving as the upper die and the area of the lower molded plate is slightly smaller than that of the product region of the sheet, whose configuration is similar to that of the upper molded plate. The product region of the sheet is entirely sandwiched between the two molded plates when the movable die is moved toward the fixed die with the sheet placed on the top surface of the molded plate of the fixed die. Thereafter the sheet is cut by the blade along the punching line so that the waste region of the sheet is separated from the product region thereof and dropped.

The operation of the above-described construction is as follows: The upper molded plate is connected to the base plate of the movable die by slidably inserting a guide shaft mounted on the upper molded plate through an opening or a groove formed through the base plate or the blade which projects downward therefrom. When a waste removing operation is not carried out, the bottom surface of the upper molded plate is disposed below the top of the blade. When a waste removing operation is performed, i.e. when pressure is applied to the upper molded plate, the upper molded plate is moved upward toward the base plate with a certain interval provided between the inner face of the blade and the upper molded plate.

According to the above-described construction, the following advantage can be obtained. The upper molded plate having substantially the same configuration as the lower molded plate is mounted on the movable die through the elastic member, and the lower molded plate serves as the base plate of the fixed die. Thus, the entire product region of the sheet placed on the top surface of the base of the fixed die is sandwiched between the two molded plates. Thus, even a thin or a flexible sheet can be reliably cut with the sheet held flat along a punching line formed thereon in the above process. The product region of the sheet separated from the waste region thereof does not wrinkle, because both surfaces of the sheet are entirely supported by the two plates. Further, the configuration of the molded plate mounted on the movable die through the elastic member is the same as the molded plate serving as the base plate of the fixed die, and the areas of these two molded plates are slightly smaller than the area of the product region of the sheet. Accordingly, even though the configuration of the sheet is complicated, the molded plates can be easily manufactured, and as such the manufacturing cost of the waste removing apparatus is not expensive.

According to still another preferred embodiment, a waste removing apparatus, for use in a punching machine for manufacturing a carton, for removing a waste region of a sheet to be punched while inserted between a movable die and a fixed die by cutting the sheet along a punching line formed thereon comprises: two molded plates. The configurations of the molded plates are substantially identical to that of the product region of the sheet for sandwiching the product area. A projection, whose configuration is substantially identical to that of the waste region, is provided for separating the waste region from the product region thereof.

According to the above-described construction, the following advantage can be obtained: Since the projection whose configuration is similar to the waste area of the sheet is mounted on the base plate of the movable die, it is unnecessary to provide the waste removing apparatus with a pin conventionally required and a mechanism for moving the pin upward and downward. Therefore, the apparatus can be easily assembled. Further, the apparatus can be compact.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
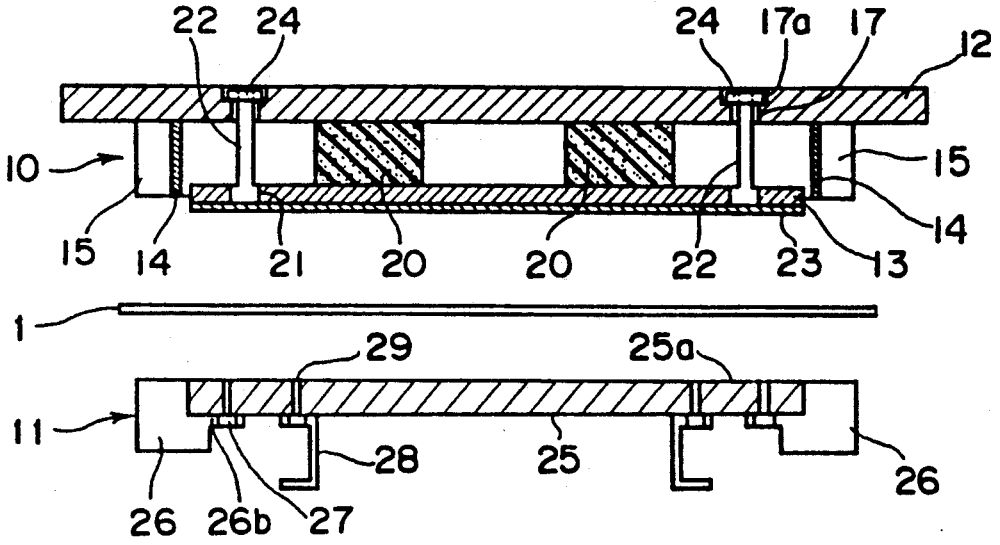
FIG. 1 is a sectional view showing one embodiment of a waste region removing apparatus in accordance with the present invention.

Before the description of the present invention proceeds, it is to be noted that like parts are designated by like reference numerals throughout the accompanying drawings.

Referring now to the drawings, there is shown in FIG. 1 a waste removing apparatus according to one preferred embodiment of the present invention. Referring to FIG. 1, a sheet 1 to be die-cut (hereinafter referred to as sheet) is transported by a transporting means (not shown) so that the sheet 1 is inserted between a fixed die 11 and a movable die 10. Thereafter, the movable die 10 is moved downward toward the fixed die 11 by a driving means (not shown) so as to separate a waste region 2 of the sheet 1 from a product region (P) thereof and drop the waste region 2, or the waste, downward.

Figure 2:
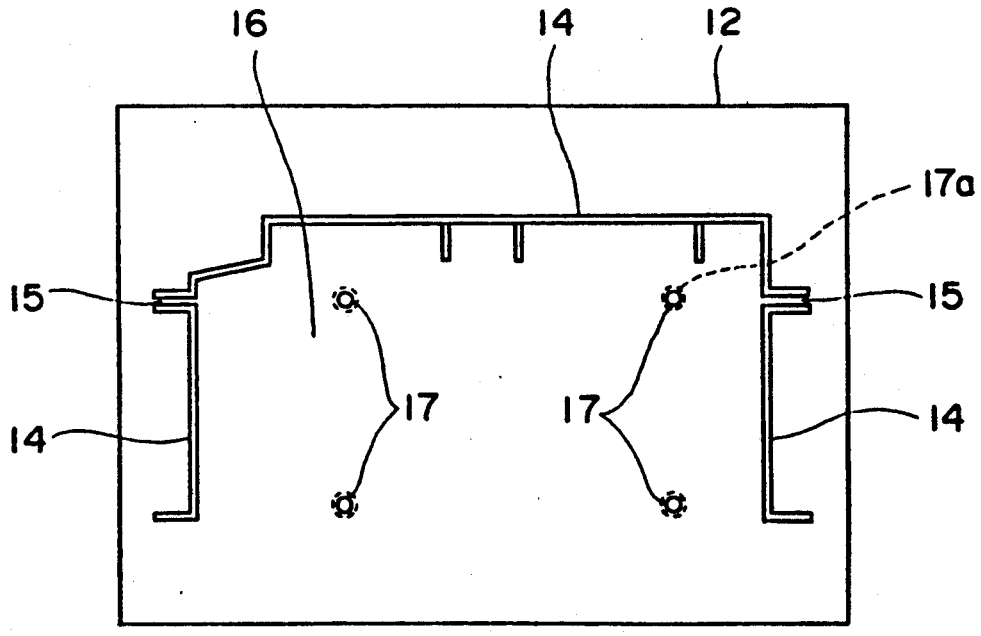
FIG. 2 is a bottom view showing a base plate of a movable die.
Figure 3:
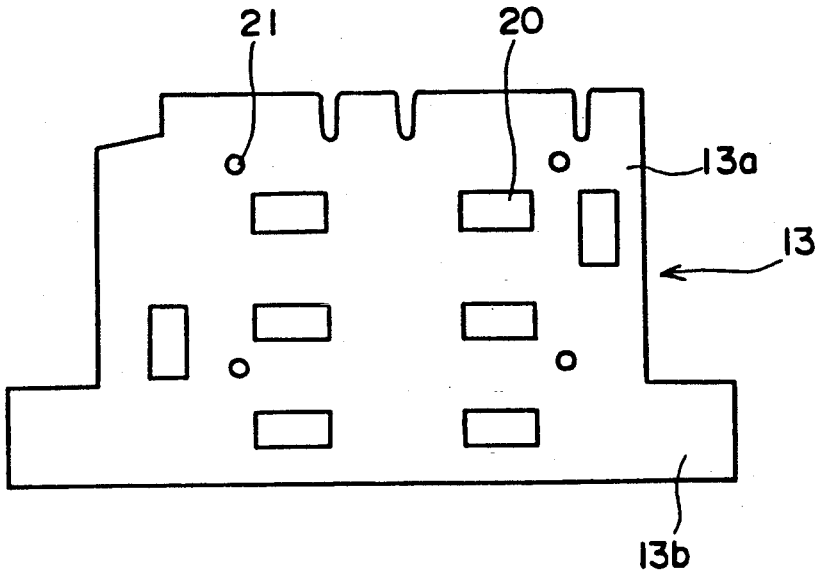
FIG. 3 is a plan view showing a molded plate.
Figure 4:
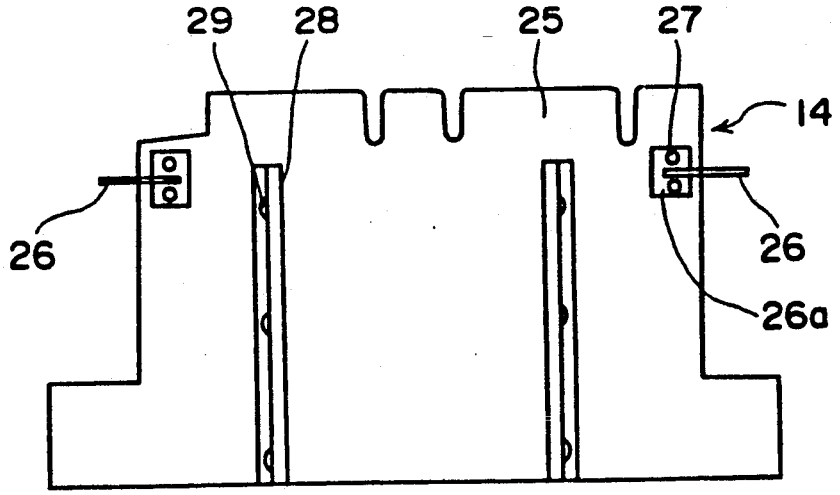
FIG. 4 is a bottom view showing a fixed die.
Figure 12:
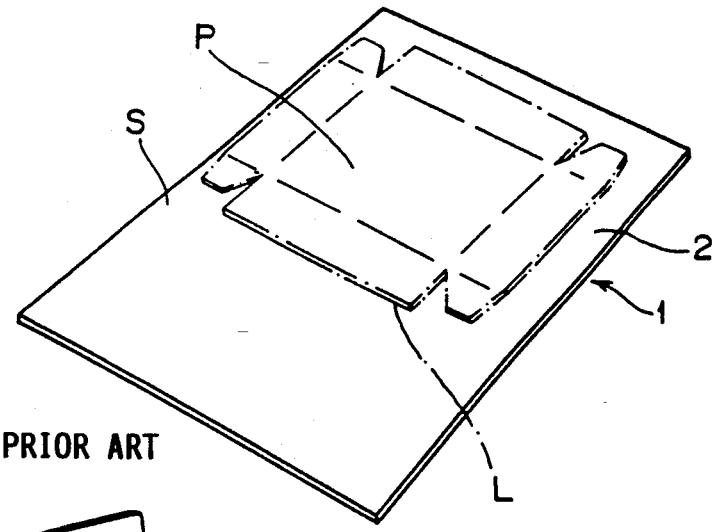
Fig. 12 PRIOR ART
FIG. 12 is a perspective view showing a sheet to be punched.

The movable die 10 comprises a laminated base plate 12 as shown in FIG. 2 and a molded plate 13 as shown in FIG. 1 connected to each other through a guide shaft 22 so that the latter is disposed below the former. A thin metallic blade 14 having an appropriate height and width projects from the bottom surface of the base plate 12. The area surrounded by a line formed by connecting a plurality of the blades 14 is a little greater than that of the product region (P) (shown in FIG. 12) by approximately 1.5~2 mm in correspondence with the configuration of the product region (P) of the sheet 1. A pair of nicks 15 for separating the waste region 2 of the sheet 1 from the product region (P) thereof are formed at required positions of the base plate 12 by spacing the blades 14 at a predetermined interval. A region 16 surrounded by the plurality of blades 14 corresponds to the area of the product region (P). A guide opening 17 is formed in the vicinity of each of the four corners of the region 16, supposing that the region 16 is a rectangle. A large diameter concave recess 17*a* to lock the guide shaft 22 at the lowest position thereof is formed on the upper portion of each of the guide openings 17.

The molded plate, 13, which is a thin flat plate serves as a means for holding the entire upper surface of the product region (P) in cooperation with a molded plate 25 of the fixed die 11. The edge line of the molded plate 13 coincides with the product region (P), or is disposed internally of the edge line of the product region (P) with a slight interval provided between the molded plate 13 and the product region (P). The molded plate 13 comprises a product region gripping portion 13*a* whose edge line corresponds to the edge line of the product region (P) and an end portion 13*b* which confronts the end portion of the sheet 1 to be held by a sheet transporting means. A plurality of elastic members 20 each made of a rectangular sponge, are fixed to the top surface of the molded plate 13, spaced at an appropriate intervals therebetween. The elastic members 20 may also be composed of, for example, a coil spring or similar elastic members.

As shown in FIG. 1, the lower end portion of a cylindrical guide shaft 22 is screwed into each of guide openings 21 formed in the vicinity of the four corners of the molded plate 13 so as to fix the guide shaft 22 to the molded plate 13. A resin layer 23 of for example, Teflon, which is smooth, is entirely formed on the bottom surface of the molded plate 13.

As described above, the movable die 10 comprises the base plate 12 and the molded plate 13 having the elastic member 20 thereon and connected to the base plate 12 through the guide shaft 22. That is, the upper portion of each of the guide shafts 22 is inserted into the corresponding guide opening 17 formed through the base plate 12, and a nut 24 is tightened on a screw formed downward from the top of each of the guide shafts 22 in the circumferential face of each of the guide shafts 22. As shown in FIG. 1, the nut 24 is locked in the upper concave portion 17*a* of the guide opening 17 so as to connect the molded plate 13 and the base plate 12 with each other. The peripheral face of the molded plate 13 is spaced at a slight interval from the inner face of the blade 14 projecting downward from the base plate 12. When a waste removing operation is performed, the molded plate 13 presses the elastic member 20 upward, with the result that the molded plate 13 moves upward along the inner face of the blade 14 and then is pressed into the region 16 surrounded by the blade 14. When the waste removing operation is suspended, i.e., when pressure applied to the elastic member 20 is released, the molded plate 13 is moved downward by the urging force of the elastic member 20. Consequently, the molded plate 13 is returned to the position shown in FIG. 1. When the waste removing operation is not performed, the resin layer 23 formed on the bottom surface of the molded plate 13 is positioned below the top of the blade 14. Accordingly, when the movable die 10 is moved toward the fixed die 11 with the sheet 1 sandwiched therebetween, the molded plate 13 contacts the top surface of the sheet 1 before the blade 14 contacts therewith, i.e., the sheet 1 is sandwiched between the bottom surface of the molded plate 13 and the top surface of the fixed die 11.

The fixed die 11 comprises a molded plate 25 comprising a thick laminated base plate. The area of the molded plate 25 is slightly smaller than that of the product region (P) and the edge line thereof coincides with that of the molded plate 13. The bottom surface of the product region (P) is supported by a smooth top surface 25*a* of the molded plate 25. A resin layer such as Teflon, which is smooth, may be formed on the top surface 25*a* of the molded plate 25. The molded plate 25 is provided with a thin metallic blade 26 located at a position corresponding to the pair of nicks 15 mounted on the movable die 10. The top surface of the blade 26 is flush with that of the molded plate 25 and the bottom of the blade 26 is disposed below the bottom surface of the molded plate 25. A bracket 26*a* projecting downward from the molded plate 25 is fixed to the bottom surface of the molded plate 25 through a pin 27. When the movable die 10 is moved downward, the blade 26 is inserted into the nick 15. A pair of channel-shaped arms 28 are fixed to the bottom surface of the molded plate 25 through a screw 29 so that the fixed die 11 is mounted on a fixed frame (not shown) through the arms 28.

The movable die 10 and the fixed die 11 are fixed to a movable frame (not shown) and a fixed frame (not shown), respectively, with adjustment of the interval between the movable die 10 and the movable frame as well as the interval between the fixed die 11 and the fixed frame. The movable frame is moved upward and downward by a driving device (not shown). When the movable frame is moved downward, the blade 26 is inserted into the nick 15 and the blade 14 is fitted onto the outer edge of the molded plate 25 of the fixed die 11.

Figure 5:
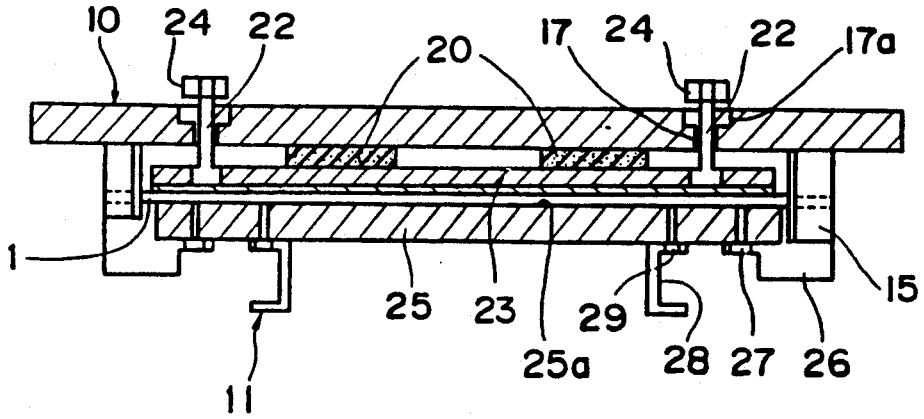
FIG. 5 is a sectional view showing a state in which the apparatus is performing an operation.
Figure 6:
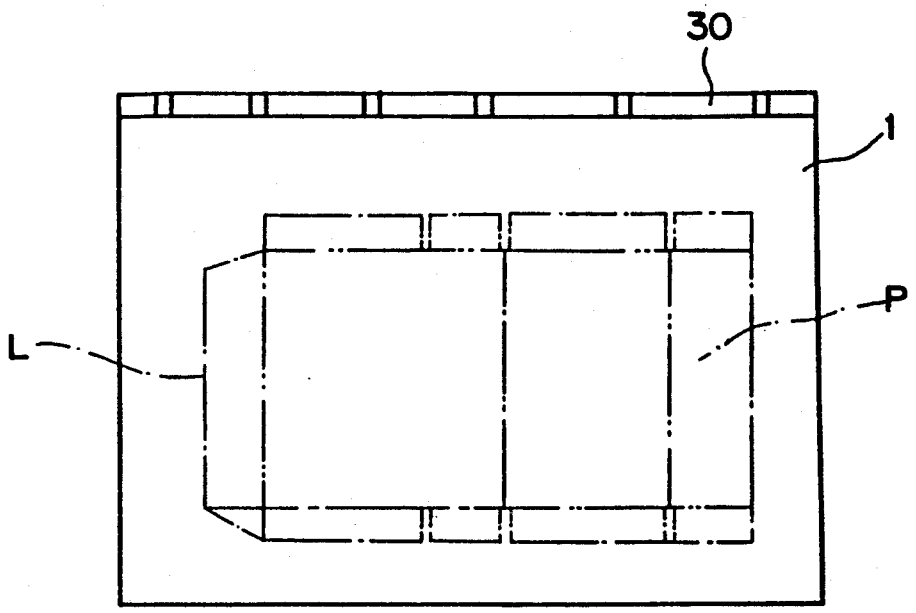
FIG. 6 is a plan view showing a sheet to be punched.
Figure 7:
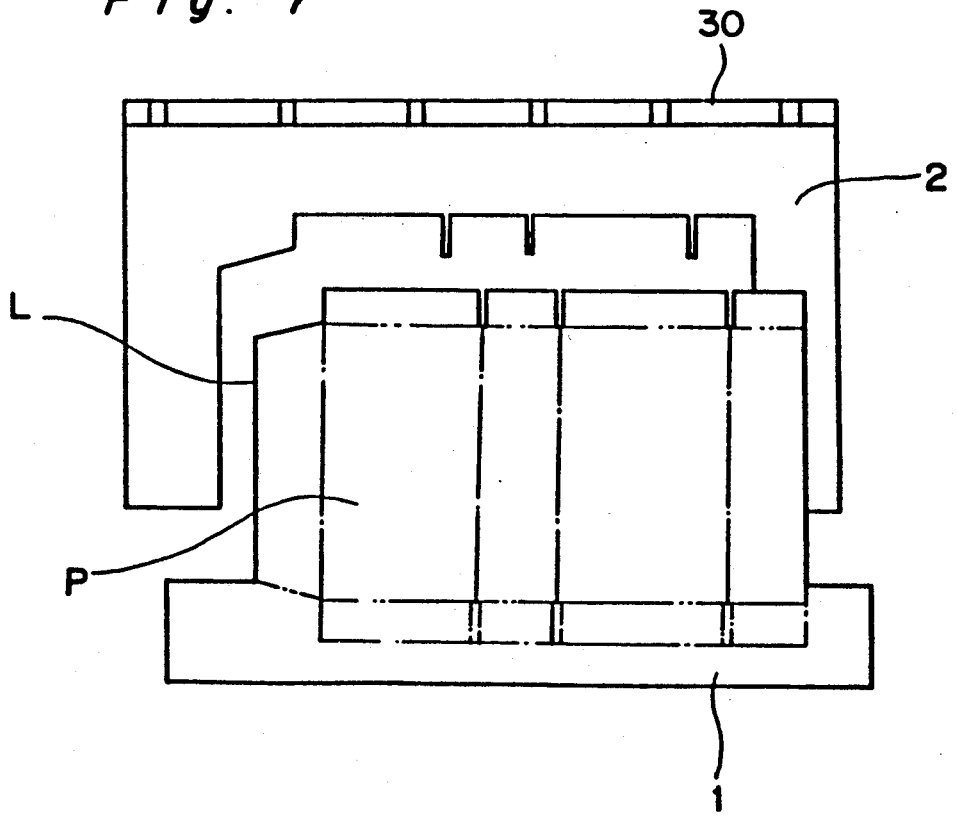
FIG. 7 is a plan view showing a product region of a sheet separated from a waste region thereof.

Referring to FIGS. 5 through 7, the operation for stripping the waste region 2 from the sheet 1 to be performed by the waste removing apparatus in accordance with the present invention is described below.

As shown in FIG. 6, the sheet 1 having the product region (P) punched to a predetermined configuration beforehand by a punching section is transported to the waste removing apparatus with one side of the sheet 1 gripped by a transporting means 30. Thereafter, the sheet 1 is stopped at a predetermined position located above the molded plate 25 of the fixed die 11 so as to place the sheet 1 on the top surface 25*a* of the molded plate 25. With the downward movement of the movable die 10, the resin layer 23 which is the lowermost portion of the molded plate 13 is brought into contact with the top surface of the sheet 1. As described previously, the configuration of the molded plate 13 is approximately the same a that of the product region (P), the area of the molded plate 13 is a little smaller than that of product region (P), and the edge line of the molded plate 25 of the fixed die 11 coincides with that of the molded plate 13. Therefore, the product region (P) is entirely sandwiched between the molded plate 13 and the molded plate 25.

With the further downward movement of the movable die 10 with the upper and bottom surfaces of the sheet 1 supported by the molded plates 13 and 25, the molded plate 13 compresses the elastic member 20, thus moving upward into the region 16 surrounded by the blade 14 along the inner face of the blade 14 as shown in FIG. 5. Since the urging force of the elastic member 20 is applied to the sheet 1 through the molded plate 13 during the upward movement of the molded plate 13, pressure is uniformly applied to the sheet 1. With the downward movement of the blade 14, the blade 14 cuts the sheet 1 along the punching line (L) formed in the previous process. As a result, as shown in FIG. 7, the waste region 2 disposed on the periphery of the product region (P) supported by the molded plates 13 and 25 is separated from the product region (P), with the product region (P) held on the molded plate 25. At this time, the blade 26 is inserted into the waste region 2 separated from the product region (P). Consequently, the waste region 2 is cut and is dropped from the fixed die 11.

When the movable die 10 moves upward thereafter, the elastic member 20 presses the molded plate 13 downward. As a result, the bottom surface of the molded plate 13 is disposed below the top of the blade 14, that is, the molded plate 13 returns to the position as shown in FIG. 1. The product region (P) separated from the waste region 2 is incapable of adhering to the molded plate 13 which is moving upward due to the upward movement of the movable die 10. Thus, the product region (P) remains held by the base plate 25 of the fixed die 11. In addition, since the bottom surface of the molded plate 13 is covered with the resin layer 23 consisting of such as Teflon, which is smooth, the product region (P) separated from the waste region 2 never adheres to the bottom surface of the molded plate 13.

Figure 8A:
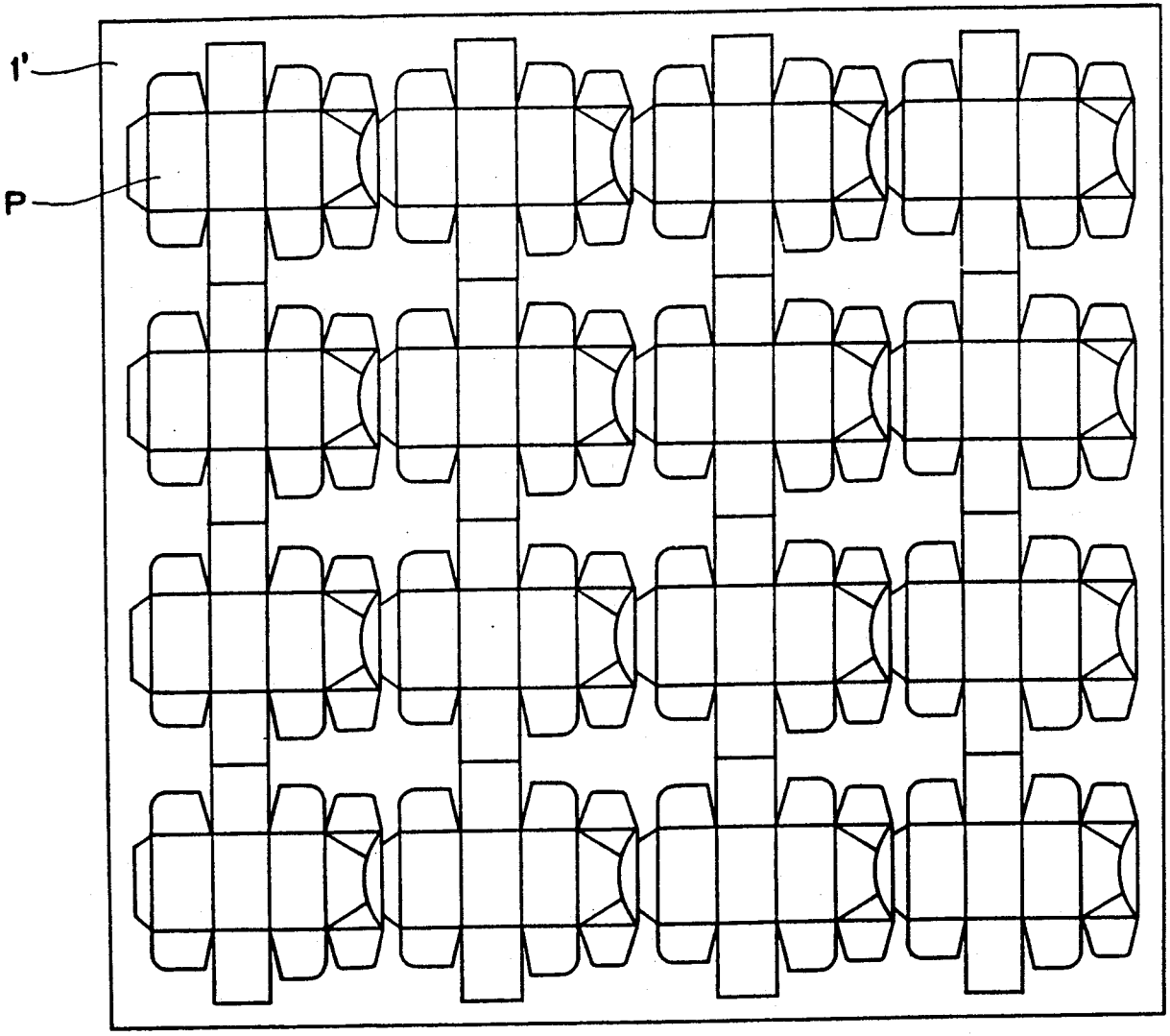
FIGS. 8A and 8B show a sheet to be punched by a waste removing apparatus in accordance with the present invention.
Figure 8B:
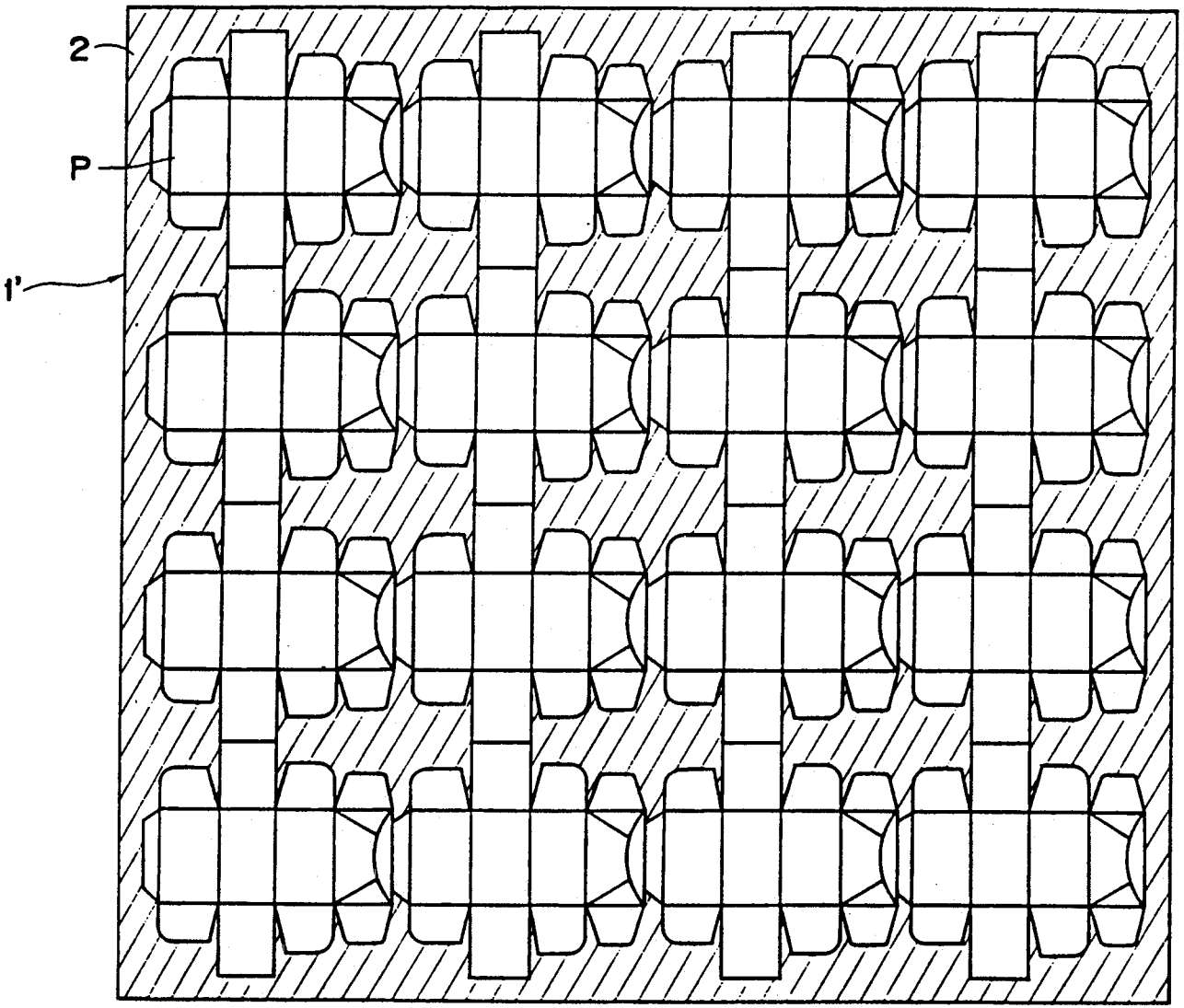

The embodiment of FIGS. 6 and 7 shows the case in which only one product region (P) is punched from one sheet so as to form one carton of a comparatively large volume. As shown in FIGS. 8A and 8B, an embodiment may be preferable wherein many product regions (P) (16 pieces according to the embodiment shown in FIGS. 8A and 8B) are punched from one thin sheet so as to form many cartons of a comparatively small volume. In punching many product regions from one sheet, a sheet in the thickness of approximately 0.1 mm~0.2 mm is used and cartons made by punching the product regions (P) are used to contain cosmetics of a small volume.

FIG. 8A shows a sheet 1' having a plurality of product regions (P) to be punched, and oblique lines of FIG. 8B show a waste region 2' to be separated from the product regions (P). In punching the product regions (P) from the sheet 1', similarly to the above-described embodiment, two molded plates whose configurations correspond to the product regions (P) are used to sandwich the product regions (P).

Figure 13:
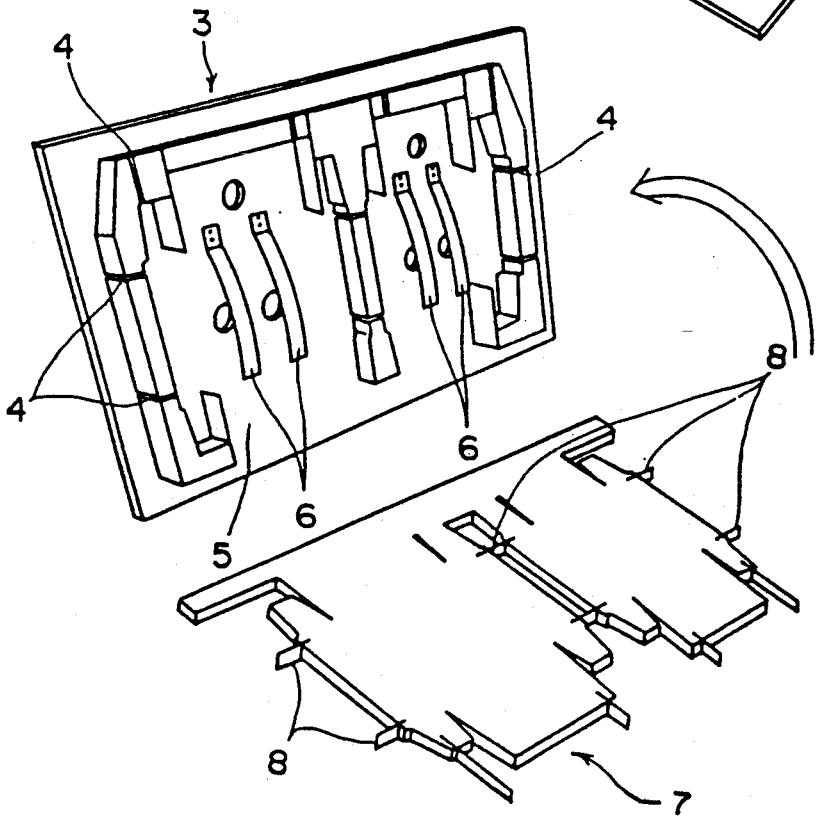
Fig. 13 PRIOR ART
FIG. 13 is a perspective view showing a known waste removing apparatus.

As apparent from the foregoing description, when one sheet has a lot of product regions (P), there are many punching lines (L) throughout a sheet. According to the known waste removing apparatus as shown in FIG. 13 in which a sheet is partially supported by the elastic member, the sheet cannot be held to be flat, which leads to the incorrect separation of the waste from the product region (P) and/or the formation of wrinkles of the product region (P). These problems occur in the case of a thin sheet as well. Compared with the known waste removing apparatus, according to the present invention, the upper and lower faces of the product region (P) are entirely supported by the molded plates. Therefore, the above-described problems do not occur and even in the case of a thin sheet, the waste region 2 can be reliably separated from the product region (P) with the sheet held to be flat.

Experiments conducted by the applicant indicate that the waste removing apparatus in accordance with the present invention is capable of separating a product region and a waste region 2 from each other when the thickness of a sheet is 0.1 mm or more, preferably, 0.2 mm or more.

Figure 9:
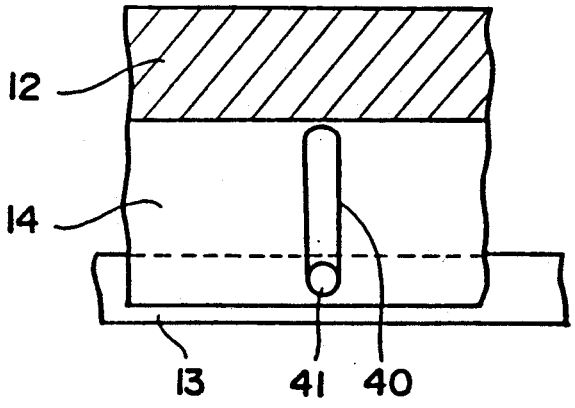
FIG. 9 is a partially sectional view showing a modification of the present invention.

The present invention is not limited to the above-described embodiments. As shown in FIG. 9, the molded plate 13 of the movable die 10 may be connected with the base plate 12 by the following method: A guide shaft 41 projectingly mounted on an outer end face of the molded plate 13 is slidably inserted through a guide hole 40 formed on the blade 14 which projects downward from the base plate 12. The guide hole 40 is vertically elongated and coincides with the guide shaft 41. Similarly to the above-described embodiment, when a punching operation is not carried out, the molded plate 13 is urged by the elastic member (not shown in FIG. 9) fixed to the molded plate 13, so that the molded plate 13 is located in the position in which the guide shaft 41 is locked by the lower end of the guide hole 40. When a waste removing operation is performed, the guide shaft 41 moves upward through the guide hole 40 against the urging force of the elastic member. Instead of this construction, a coil spring may also be adopted to connect the elastic member with both the molded plate 13 and the base plate 12. That is, one end of the coil spring is fastened to the top surface of the molded plate 13 and the other end thereof is fastened to the bottom surface of the base plate 12. Thus, the molded plate 13 can be moved upward and downward with respect to the base plate 12.

Figure 10:
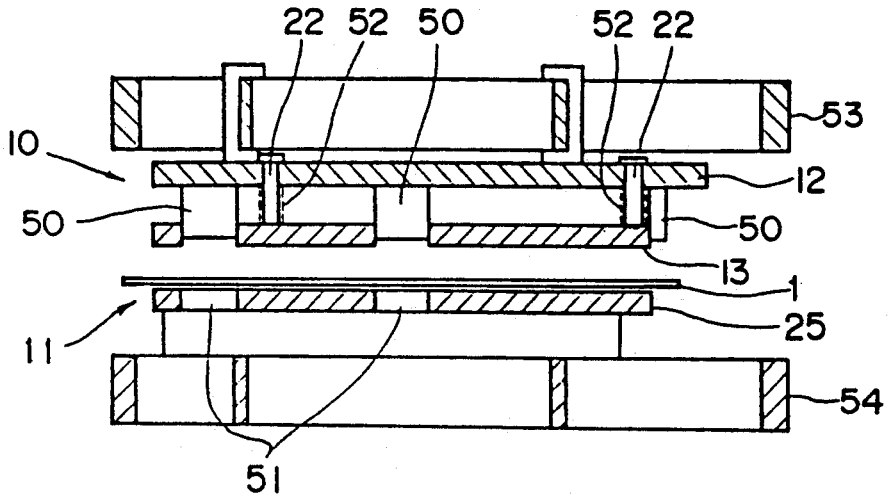
FIG. 10 is a sectional view showing one embodiment of a waste region removing apparatus in accordance with the present invention in which the apparatus has not started a waste removing operation.
Figure 11:
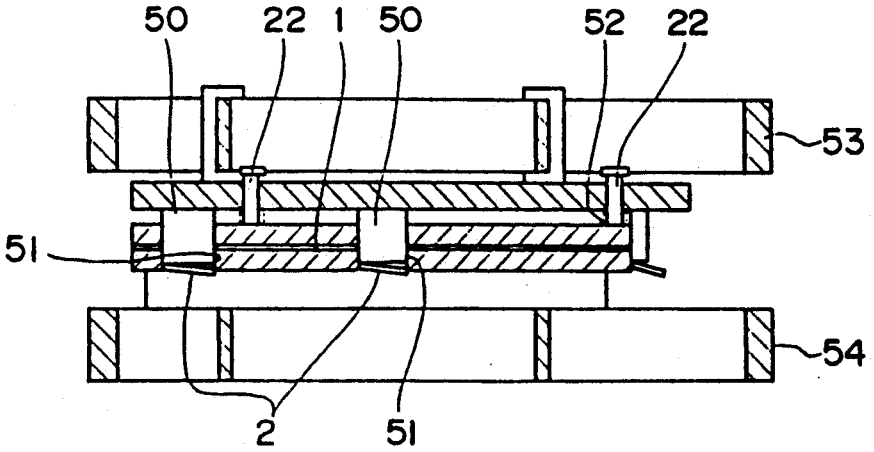
FIG. 11 is a sectional view showing one embodiment of the waste region removing apparatus in accordance with the present invention shown in FIG. 10 in which the waste removing apparatus is performing a waste removing operation.

The waste removing apparatus in accordance with the present invention may also be embodied by the constructions as shown in FIGS. 10 and 11. Projections 50, the configurations of which are similar to that of the waste region 2, are formed on the bottom surface of the base plate 12 of the movable die 10, and concaves 51 are formed in the molded plate 25 of the fixed die 11. The projection 50 corresponds to the blade 14 of the above-described embodiment. The blade 14 coincides with the punching line (L) of the waste region 2 while the projection 50 corresponds to the configuration of the waste region 2. When a waste removing operation is carried out, the projection 50 is fitted into the concave 51.

In this embodiment, a coil spring 52 is wound around the guide shaft 22 which connects the molded plate 13 of the movable die 10 and the base plate 12 to each other so that the molded plate 13 is elastically supported by the base plate 12. Similarly to the above-described embodiment, when an operation for separating the waste region 2 from the product region (P) is not performed, the coil spring 52 urges the molded plate 13, so that the bottom surface of the molded plate 13 is disposed below the bottom surface of the projection 50. The waste region 2 is separated from the product region (P) by the projection 50 with the sheet 1 supported by the molded plate 13.

Referring to FIGS. 10 and 11, the movable die 10 is fixed to a frame 53 by adjusting its position, and the fixed die 11 is fixed to a frame 54 by adjusting its position.

The construction shown in FIGS. 10 and 11 is effective in punching the waste region 2 from the product region (P) when the waste region 2 cannot be easily punched, i.e., when the configuration of the waste region 2 is complicated or a small circle. That is, since the projection 50 is fitted into the concave 51 with the product region (P) supported by the molded plates 13 except the waste region 2, the waste region 2 can be reliably separated from the product region (P).

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A waste removing apparatus for removing waste portions from a production region of a sheet of paper along punch lines on the sheet of paper, comprising:

a first cutting die for engaging the sheet of paper for removal of waste portions from the product region thereof therefrom, said first cutting die having a first holding plate for holding the product region of the sheet of paper, said first holding plate having a predetermined configuration corresponding to the shape of the product of the region;

a second cutting die for engaging the sheet of paper together with said first cutting die to remove the waste portions from the product region of the sheet of paper, said second cutting die comprising a second holding plate for holding the product region of the sheet of paper, whereby said first and second holding plates hold the sheet of paper therebetween when the waste portions are removed, said second holding plate having a predetermined configuration corresponding in to the shape of the desired product region and corresponding to the configuration of said first holding plate; and cutting means on said second cutting die for removing the waste portions of the sheet of paper not within the area of the sheet of paper held by said first and second holding plates when said first and second cutting dies hold the sheet of paper therebetween with said first and second holding plates;

wherein both said first and second holding plates have flat planar surfaces for uniformly applying pressure to the product region of the sheet of paper for holding the sheet of paper securely therebetween;

wherein said second holding plate is movably mounted on said second cutting die and has biasing means for resiliently biasing said second holding plate toward said first holding plate when said first and second holding plates are engaged;

wherein said second cutting die has a base plate, said second holding plate is movably connected to said base plate, and said biasing means comprises elastic members disposed between said second holding plate and said base plate; and wherein said cutting means comprises a plurality of blades extending about the periphery of said second holding plate and having substantially the same configuration as said first and second holding plates, said blades being spaced from each other at predetermined intervals.

2. The waste removing apparatus of claim 1, wherein said first holding plate is fixed to said first cutting die.

3. The waste removing apparatus of claim 1, wherein said second holding plate has a smooth resin layer thereon for engaging the sheet of paper.

4. The waste removing apparatus of claim 1, wherein said cutting means does not extend from said base plate as far as said position of maximum distance of said second holding plate.

5. The waste removing apparatus of claim 1, wherein said predetermined interval between said blades comprise nicks for separating the waste portions for the product region of the sheet of paper.

6. The waste removing apparatus of claim 5, wherein said first holding plate has thin blades thereon corresponding in position to said nicks between said blades of said second cutting die for cutting the waste portions.

* * * * *